US007792318B2

(12) United States Patent
Ushikoshi et al.

(10) Patent No.: US 7,792,318 B2
(45) Date of Patent: Sep. 7, 2010

(54) SPEAKER

(75) Inventors: Akinori Ushikoshi, Nagano (JP); Shinsuke Takahashi, Nagano (JP); Kenji Yokoyama, Tokyo (JP)

(73) Assignee: Nidec Pigeon Corporation (JP)

( * ) Notice: Subject to any disclaimer, the term of this patent is extended or adjusted under 35 U.S.C. 154(b) by 1014 days.

(21) Appl. No.: 11/528,945

(22) Filed: Sep. 28, 2006

(65) Prior Publication Data

US 2007/0071271 A1 Mar. 29, 2007

(30) Foreign Application Priority Data

Sep. 28, 2005 (JP) ..... 2005-282181

(51) Int. Cl.
*H04R 25/00* (2006.01)

(52) U.S. Cl. ..... 381/396; 381/96; 381/407

(58) Field of Classification Search ..... 381/96, 381/117, 396, 400, 401, 407, 409, 410, 412, 381/420; 29/594, 602.1, 605, 609.1
See application file for complete search history.

(56) References Cited

U.S. PATENT DOCUMENTS 4,188,711 A * 2/1980 Babb ..... 29/594
4,550,430 A * 10/1985 Meyers ..... 381/96
5,197,104 A * 3/1993 Padi ..... 381/96

FOREIGN PATENT DOCUMENTS

| | | |
|---|---|---|
| JP | 52-079644 | 7/1977 |
| JP | 53-012319 | 2/1978 |
| JP | 53-012320 | 2/1978 |
| JP | 53-012321 | 2/1978 |
| JP | 57-096589 | 6/1982 |

* cited by examiner

*Primary Examiner*—Huyen D Le
(74) *Attorney, Agent, or Firm*—Cantor Colburn LLP

(57) ABSTRACT

A speaker may include a center pole, a voice coil bobbin having a nonmetallic pipe body, and a first and a second electrodes which are provided on an inner peripheral face of the pipe body for detecting an electrostatic capacity. The first and the second electrodes are disposed so as to be separated from each other with a predetermined space along an axial direction of the center pole. Further, a stepped portion may be formed in the side circumferential face of the center pole such that, when the voice coil bobbin is operated, a first facing area of the first electrode to the side circumferential face defined by the stepped portion of the center pole increases while a second facing area of the second electrode to the side circumferential face defined by the stepped portion of the center pole decreases by a same amount as an increased amount of the first facing area.

10 Claims, 8 Drawing Sheets

(a)

(b)

(c)

SPEAKER

CROSS REFERENCE TO RELATED APPLICATION

The present invention claims priority under 35 U.S.C. §119 to Japanese Application No. 2005-282181 filed Sep. 28, 2005, which is incorporated herein by reference.

FIELD OF THE INVENTION

An embodiment of the present invention may relate to a speaker. More specifically, an embodiment of the present invention may relate to a speaker which detects an electrostatic capacity formed between a voice coil bobbin and a center poles to control the operation of a diaphragm on the basis of the detection result.

BACKGROUND OF THE INVENTION

In some audio speakers, a Motion Feed Back (MFB) circuit is included to improve the sound quality of the speaker. The MFB circuit detects the operating state of a diaphragm which vibrates through an electrical signal conveying audio information (hereinafter referred to as an "audio signal") that is inputted into the speaker. The MFB circuit feedback-controls the diaphragm based on the detection result. In this manner, the distortion of sound that is likely to occur especially in a low tone region can be canceled. Therefore, it is sometimes mistakenly assumed that the MFB circuit is effective to be utilized in a small-sized speaker in which reproduction in a low tone region is difficult.

For example, the following five references with regard to a MFB circuit are known: Japanese Patent Laid-Open No. Sho 52-79644, Japanese Patent Laid-Open No. Sho 53-12319, Japanese Patent Laid-Open No. Sho 53-12320, Japanese Patent Laid-Open No. Sho 53-12321, and Japanese Utility Model Laid-Open No. Sho 57-96589. In these references, the operating state of the diaphragm is detected by detecting the variation of an electrostatic capacity formed between electrodes. More specifically, an electrode (hereinafter, referred to as "movable electrode") is fixed to a diaphragm, or fixed to an electromagnetic coil which is referred to as a voice coil bobbin that causes the diaphragm to vibrate, and another electrode (hereinafter, referred to as "fixed electrode") is fixed so as to face the movable electrode. An electrostatic capacity varied by the movable electrode that moves relative to the fixed electrode is detected and outputted as a detection signal. A comparison device (for example, CPU) compares the detection signal with a predetermined reference value to control so as to amend the operation of the diaphragm on the basis of the comparison result.

However, the electrostatic capacity that is formed between the electrodes is very small, for example, from several pF (picofarad) to several hundred pF. Therefore, the electrostatic capacity is affected and varied by noise such as a few amount of an electromagnetic wave or static electricity. For example, a diaphragm is commonly structured to be vibrated by an excitation effect between a voice coil bobbin, an iron core which is inserted into the voice coil bobbin and referred to as a center pole, and a magnet which generates a magnetic flux passing through the voice coil bobbin and the center pole. However, the electrostatic capacity between the electrodes is affected and varied by an exciting current flowing through the voice coil bobbin. Further, some of electronic components which are incorporated into the speaker emit an electromagnetic wave although it may be weak, and the electrostatic capacity may be varied by the electromagnetic wave which transmits to the electrodes. Further, the electrostatic capacity between the electrodes may be affected by friction accompanied with mechanical phenomena such as the vibration of components which are incorporated in the speaker, static electricity caused by various electromagnetic phenomena in the inside and the outside of the speaker, electromagnetic waves which are outputted by electronic equipment installed around the speaker, or the like. Thus, in the above-mentioned references, since the electrostatic capacity varies as described above, the electrostatic capacity formed between the electrodes is unable to be accurately detected.

SUMMARY OF THE INVENTION

In view of the problems described above, an embodiment of the present invention may advantageously provide a speaker in which an electrostatic capacity formed between electrodes can be accurately detected.

Thus, according to an embodiment of the present invention, there may be provided a speaker including a center pole, a voice coil bobbin which includes a nonmetallic pipe body, and a first and a second electrodes which are provided on an inner peripheral face of the pipe body for detecting an electrostatic capacity that is formed between the electrodes and the center pole. The first and the second electrodes are disposed on the inner peripheral face of the pipe body and are separated from each other with a predetermined space along an axial direction of the center pole. In addition, the speaker further includes a stepped portion which is formed in a side circumferential face of the center pole such that, when the voice coil bobbin is operated, a first facing area of the first electrode to the side circumferential face defined by the stepped portion of the center pole increases while a second facing area of the second electrode to the side circumferential face defined by the stepped portion of the center pole decreases by the same amount as an increased amount of the first facing area. In this structure as described above, when a subtracter is provided which subtracts a second electrical signal obtained from the second electrode from a first electrical signal obtained from the first electrode and which outputs a third electrical signal corresponding to a result of the subtraction, an electrostatic capacity formed between the voice coil bobbin and the center pole can be accurately detected. The subtracter may be provided in the speaker.

In accordance with an embodiment of the present invention, when the voice coil bobbin is operated, the first facing area of the first electrode to the stepped portion of the center pole increases and the second facing area of the second electrode to the stepped portion of the center pole decreases by the same amount as an increased amount of the first facing area. Therefore, an electrostatic capacity formed between the first electrode and the stepped portion increases and an electrostatic capacity formed between the second electrode and the stepped portion decreases by the same amount as an increased amount of the electrostatic capacity. These electrostatic capacities are detected from the respective electrodes as a first and a second electrical signals along with a disturbance noise. The first electrical signal obtained from the first electrode includes an electrical signal indicating a true electrostatic capacity formed between the first electrode and the stepped portion and an electrical signal indicating the disturbance noise entered into the first electrode. The second electrical signal obtained from the second electrode includes an electrical signal indicating a true electrostatic capacity formed between the second electrode and the stepped portion and an electrical signal indicating the disturbance noise entered into the second electrode. A phase of the electrical signal indicating the true electrostatic capacity obtained from the first electrode and a phase of the electrical signal indicating the true electrostatic capacity obtained from the second electrode are shifted each other by a phase difference of "π". Further, a phase of the electrical signal indicating the disturbance noise obtained from the first electrode and a phase of the electrical signal indicating the disturbance noise obtained from the second electrode are the same. Therefore, when the second electrical signal is subtracted from the first electrical signal with a subtracter, the electrical signals indicating the disturbance noise obtained from the respective electrodes are canceled each other and the electrical signals indicating the true electrostatic capacity obtained from the respective electrodes are added in the same phase to be detected.

In accordance with an embodiment of the present invention, each of the first and the second electrodes is comprised of nonmagnetic electric conductor films which are laminated through an insulator film. In this case, the farthest electric conductor film of the laminated electric conductor films from the side circumferential face of the center pole functions as a shield for shutting off the disturbance noise. Further, since the electric conductor films are laminated through an insulator film, the output levels of electrical signals obtained from the respective electrodes can be increased.

In accordance with an embodiment of the present invention, a nonmagnetic electric conductor film is formed on an outer circumferential face of the pipe body and is grounded. In this case, a disturbance noise is reduced by the electric conductor film formed on the outer circumferential face of the pipe body. Therefore, the disturbance noise entering into the respective electrodes is reduced.

In accordance with an embodiment of the present invention, a stepped portion is formed in a side circumferential face of the center pole such that, when the voice coil bobbin is operated, a first facing area of the first electrode to the side circumferential face defined by the stepped portion of the center pole increases and a second facing area of the second electrode to the side circumferential face defined by the stepped portion of the center pole decreases by the same amount as the increased amount of the first facing area. In order to specifically obtain such a structure, the center pole includes a cylindrical center pole main body, and the stepped portion is protruded to an outer side from the side circumferential face of the cylindrical center pole main body to form a circular ring shape protruded portion, and the stepped portion comprises rising faces which are formed to be risen up at a substantially right angle from the side circumferential face in a radial direction of the center pole main body and an opposite face which faces in a substantially parallel to the first and the second electrodes. According to the structure described above, a required stepped portion can be easily obtained.

In this embodiment, in order to increase a first facing area of the first electrode to the side circumferential face of the center pole and to decrease a second facing area of the second electrode to the side circumferential face of the center pole by the same amount as the increased amount of the first facing area when the voice, coil bobbin is operated, the first facing area of the first electrode to the opposite face of the center pole main body may be set to be the same as the second facing area of the second electrode to the opposite face of the center pole main body when the voice coil bobbin is located at a reference position. Specifically, in accordance with an embodiment, a first edge formed with one of the rising faces and the opposite face of the stepped portion is located at a position where the first edge divides the first electrode in half in the axial direction of the center pole when the voice coil bobbin is located at the reference position, and a second edge formed with the other of the rising faces and the opposite face of the stepped portion is located at a position where the second edge divides the second electrode in half in the axial direction of the center pole when the voice coil bobbin is located at the reference position.

In accordance with an embodiment of the present invention, a stepped portion is formed in a side circumferential face of the center pole such that, when the voice coil bobbin is operated, a first facing area of the first electrode to the side circumferential face defined by the stepped portion of the center pole increases and a second facing area of the second electrode to the side circumferential face defined by the stepped portion of the center pole decreases by the same amount as the increased amount of the first facing area. In order to specifically obtain such a structure, the center pole includes a cylindrical center pole main body, and the stepped portion is recessed to an inner side from the side circumferential face of the cylindrical center pole main body to form a circular ring shape recessed portion.

As described above, according to a speaker in accordance with an embodiment of the present invention, in electrical signals obtained from the respective electrodes which are formed on the inner peripheral face of the pipe body for detecting an electrostatic capacity, a component indicating a disturbance noise is canceled and a component indicating a true electrostatic capacity which is formed between the electrodes and the stepped portion can be obtained. Therefore, a third electrical signal indicating a true electrostatic capacity formed between the electrodes and the stepped portion can be effectively utilized, for example, in an MFB circuit and a conventional distortion of a sound or the like which is emitted from the speaker can be canceled.

According to a speaker in accordance with an embodiment of the present invention, since each of the first and the second electrodes is comprised of nonmagnetic electric conductor films which are laminated through an insulator film, a disturbance noise can be shut off by the farthest electric conductor film of the laminated electric conductor films from the side circumferential face of the center pole. Further, since the electric conductor films are laminated through an insulator film, the output levels of electrical signals obtained from the respective electrodes can be increased and thus reliability of the third electrical signal outputted from the subtracter can be enhanced.

Further, according to a speaker in accordance with an embodiment of the present invention, since a nonmagnetic electric conductor film is formed on an outer circumferential face of the pipe body and is grounded, a disturbance noise entering into the respective electrode is reduced by this electric conductor film and thus reliability of the third electrical signal outputted from the subtracter can be further enhanced.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which:

FIG. 4(*a*) shows a state in which two electric conductor films are formed on a rear face of an insulator film, FIG. 4(*b*) shows a state in which a tape is stuck on the rear face of the insulator film, and FIG. 4(*c*) shows a state in which other two electric conductor films are formed on the tape.

DETAILED DESCRIPTION OF THE PREFERRED EMBODIMENTS

Figure 1:
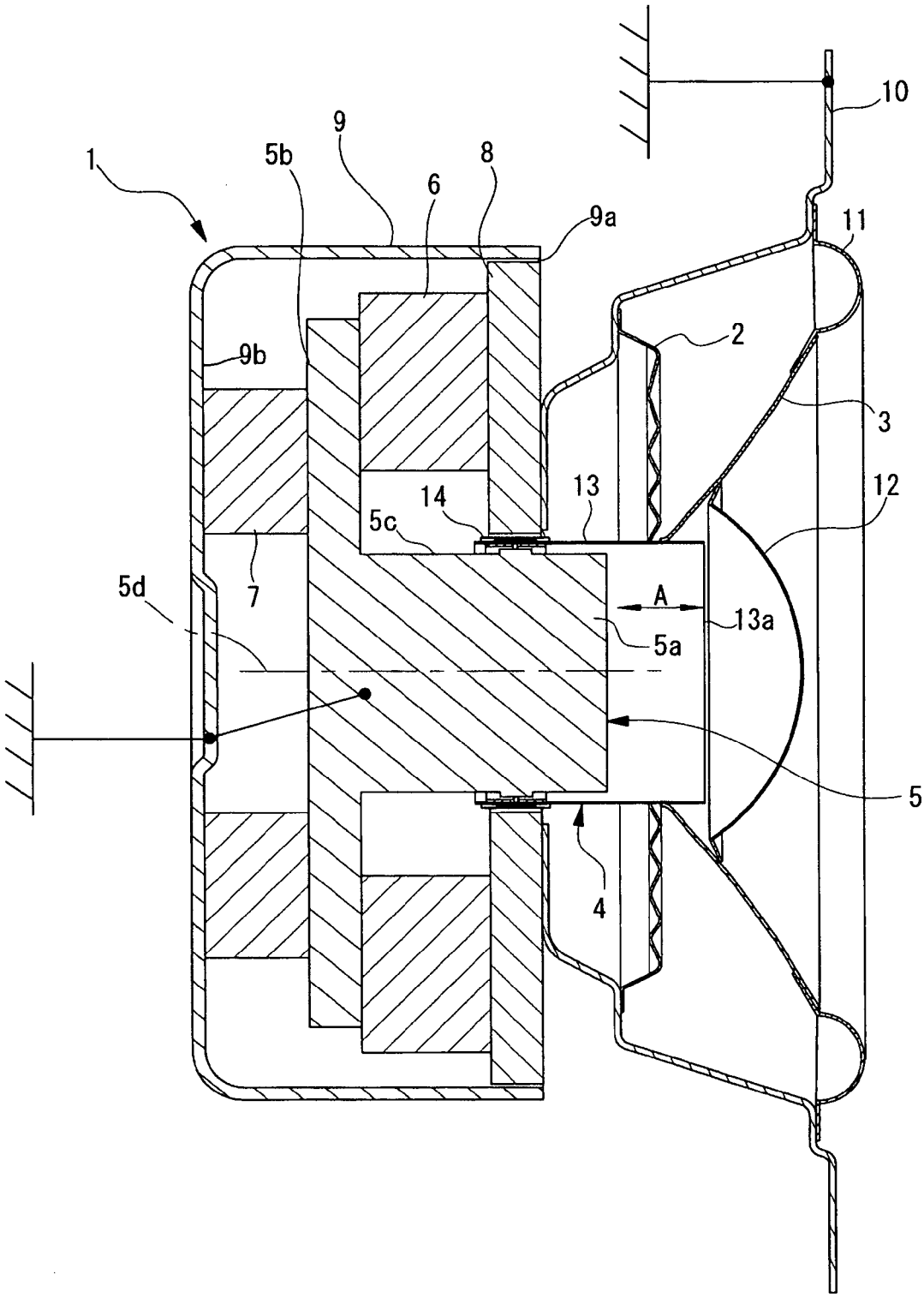
FIG. 1 is a cross-sectional view showing a structure of a speaker in accordance with an embodiment of the present invention.

A speaker in accordance with an embodiment will be described in detail below with reference to the accompanying drawings.

A speaker is shown in FIGS. 1 through 8. In a speaker 1 in accordance with an embodiment, two first electrodes 18 (18*a*, 18*b*) and two second electrodes 19 (19*a*, 19*b*) for detecting an electrostatic capacity are disposed with a predetermined space in-between on an inner peripheral face 15*b* of a pipe body 15 along an axis 5*d* direction of a center pole 5. Further, a stepped portion 5*e* is formed in the side circumferential face 5*c* with which, when a voice coil bobbin 4 is operated, a first facing area between one of the electrodes and the side circumferential face 5*c* of the center pole 5 is increased and a second facing area between the other of the electrodes and the side circumferential face 5*c* is decreased by the increased amount of the first facing area. In addition, a subtracter 31, in which subtraction between a first electrical signal obtained from one of the electrodes and a second electrical signal obtained from the other of the electrodes is performed and a third electrical signal corresponding to the result of the subtraction is outputted, is provided on the speaker 1.

As shown in FIG. 1, the speaker 1 includes a damper 2, a diaphragm 3, a voice coil bobbin 4, a center pole 5, magnets 6 and 7, a circular ring shaped member 8, a case 9, a frame 10, a connection member 11, a center cap 12 and a box-shaped speaker box (not shown) functioning as a housing. The center pole 5, the magnets 6 and 7 and the circular ring shaped member 8 are accommodated in the case 9 which is formed in a bottomed cylindrical shape. They are fixed on an inner wall face of the case 9 with an adhesive or a screw. The center pole 5 is made of iron and structured of a substantially cylindrical center pole main body 5*a* and a substantially disk-shaped flange 5*b* that is formed at a base end of the center pole main body 5*a*. The center pole 5 is disposed in the case 9 such that a tip end portion of the center pole main body 5*a* is protruded outside the case 9 from a substantially center portion of an aperture 9*a* of the case 9 and such that the axis 5*d* of the center pole main body 5*a* coincides with the center of a bottom face 9*b* of the case 9. The center pole 5 and the case 9 are mounted on the speaker box (not shown) and grounded.

The magnet 7 is formed in a substantially circular ring shape. The magnet 7 is disposed such that its center is located at the center of the bottom part 9*b* of the case 9 and fixed on the bottom part 9*b* with an adhesive. A bottom face of the flange 5*b* is fixed on a face on the aperture 9*a* side of the magnet 7 with an adhesive. The magnet 6 is formed in a substantially circular ring shape. The magnet 6 is disposed such that its center is located so as to correspond to the center of the bottom part 9*b* of the case 9 and fixed with an adhesive on a face of the flange 5*b* that faces the aperture 9*a*. The circular ring shaped member 8 which is made of iron is disposed such that its center coincides with the axis 5*d* of the center pole main body 5*a* and is fixed with an adhesive on a face of the magnet 6 that faces the aperture 9*a*.

The voice coil bobbin 4 includes a substantially cylindrical bobbin 13 whose front end and rear end are opened and a coil 14. The diameter of the bobbin 13 is set to be slightly larger than the outer diameter of the center pole main body 5*a*, and the coil 14 which is structured of an electric conductor such as an enameled wire or a copper wire is wound around the outer peripheral face of the bobbin 13. The voice coil bobbin 4 structured as described above is inserted into a gap space between an inner peripheral face of the circular ring shaped member 8 and a side circumferential face 5*c* of the center pole main body 5*a*.

The frame 10 is fixed to the face on the aperture 9*a* side of the circular ring shaped member 8 with an adhesive. Another end of the frame 10 is fixed to an edge portion of an aperture (not shown) that is formed in a front face plate of a speaker box with an adhesive or screws. An inner peripheral face of the damper 2 is fixed to an outer circumferential face of the bobbin 13 with an adhesive and an outer peripheral face of the damper 2 is fixed to an inner peripheral face of the frame 10 with an adhesive. In this manner, the voice coil bobbin 4 is held by the damper 2 between the inner peripheral face of the circular ring shaped member 8 and the stepped portion 5*e* (see FIG. 2) which is formed in the side circumferential face 5*c* of the center pole main body 5*a*. The diaphragm 3 functions as a so-called cone paper and its inner peripheral portion is fixed to the outer circumferential face of the bobbin 13 with an adhesive and its outer peripheral portion is connected with the frame 10 through the connection member 11. The center cap 12 includes a main body portion formed in a dome shape and a flange portion formed along an outer peripheral edge of the main body portion, and the flange portion is fixed to the diaphragm 3 with an adhesive. In this manner, the aperture 13*a* on the front end side of the bobbin 13 is covered by the center cap 12.

According to the structure as described above, when an audio signal is inputted into the coil 14 through a lead wire (not shown) from an input terminal 33 (see FIG. 5), the diaphragm 3 vibrates in a forward and backward direction (direction of the arrow "A" in FIG. 1) by an exciting operation between the voice coil bobbin 4, the center pole 5 and the magnet 6 to emit a sound or the like corresponding to an audio signal.

Figure 2:
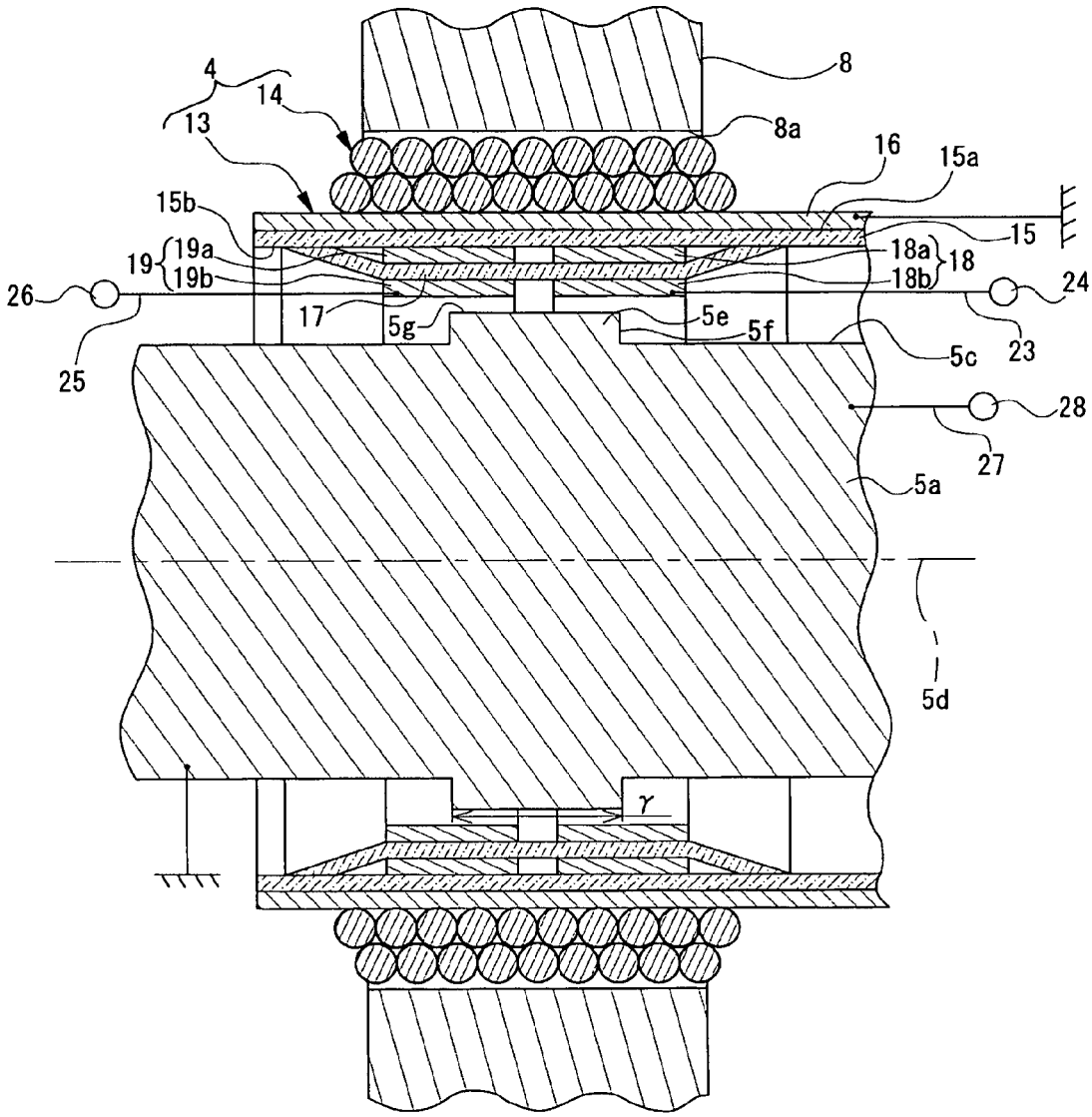
FIG. 2 is a cross-sectional view showing a part of a voice coil bobbin.
Figure 3:
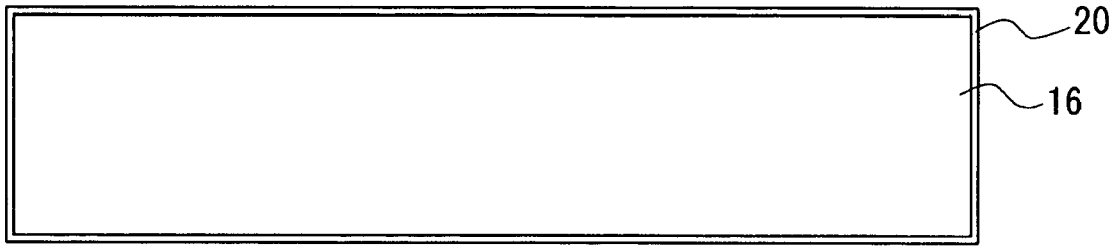
FIG. 3 is a view showing an insulator film.

As shown in FIG. 2, the bobbin 13 includes a pipe body 15, an electric conductor film 16, a tape 17, a first electrode 18 and a second electrode 19. The pipe body 15 serves as a base of the bobbin 13 and is structured by a substantially strip-shaped insulator film 20 (see FIG. 3) that is formed in a cylindrical shape. The insulator film 20 is a plastic film having flexibility and insulation property such as a polyimide or a polyester. The electric conductor film 16 is, as shown in FIG. 3, comprised of a copper foil which is stuck on the entire face of the insulator film 20, i.e., the entire face corresponding to the outer circumferential face 15*a* of the pipe body 15. The electric conductor film 16 is electrically connected to the speaker box through the case 4 and is grounded.

The first and the second electrodes 18 and 19 detect an electrostatic capacity which is formed between the center pole main body 5*a* and the first and the second electrodes 18 and 19. The first electrode 18 is structured by laminating electric conductor films 18*a* and 18*b* through the tape 17 and the second electrode 19 is structured by laminating electric conductor films 19*a* and 19*b* through the tape 17.

Figure 4:
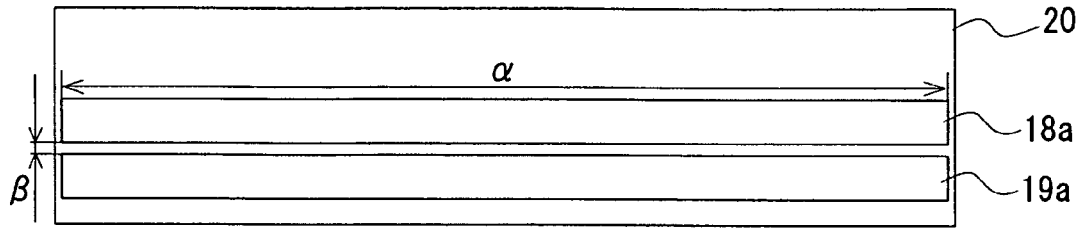
FIGS. 4(*a*), 4(*b*) and 4(*c*) are explanatory views for describing a forming method for a first electrode and a second electrode.
Figure 4:
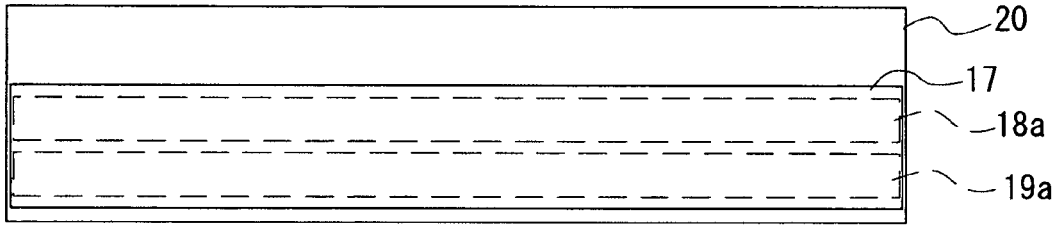
Figure 4:
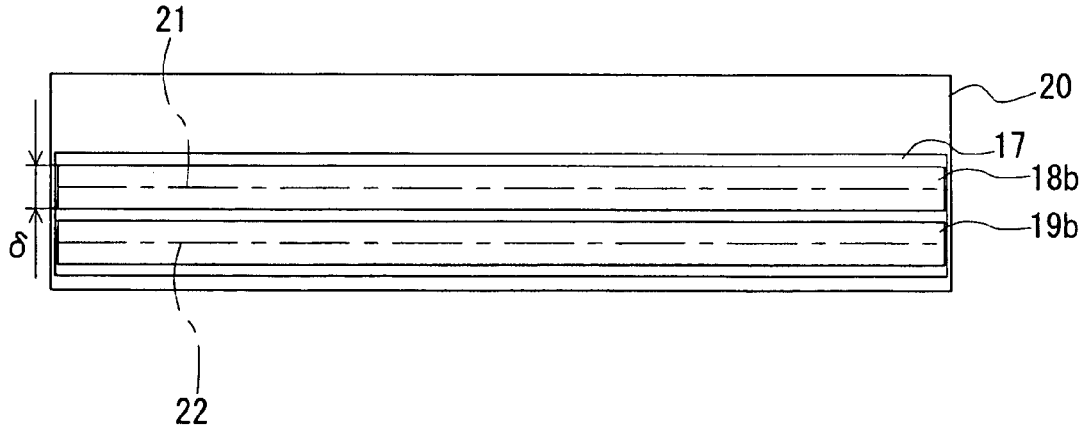

A forming method for the first electrode 18 and the second electrode 19 will be described below. As shown in FIG. 4(*a*), strip-shaped electric conductor films 18*a* and 19*a*, which has a length in a longitudinal direction of the insulator film 20, i.e., the length "α" substantially equal to the length of the internal circumference of the inner peripheral face 15*b*, are formed on a rear face of the insulator film 20, i.e., on a face corresponding to the inner circumferential face 15*b* of the pipe body 15 along a short length direction of the insulator film 20 (the direction corresponding to the direction of the axis 5*d* of the center pole 5) with a certain space "β". The electric conductor films 18*a* and 19*a* are made of a copper film and are formed of copper which is vapor-deposited on the rear face, i.e., on the inner circumferential face 15*b* of the insulator film 20. Next, as shown in FIG. 4(*b*), the tape 17, for example, formed of an insulator such as polyimide is stuck on the rear face of the insulator film 20 so as to cover the electric conductor films 18*a* and 19*a*. Then, as shown in FIG. 4(*c*), the electric conductor films 18*b* and 19*b* which are formed in the same size and the same shape as the electric conductor films 18*a* and 19*a* are formed on the tape 17 so as to overlap the electric conductor films 18*a* and 19*a* through the tape 17. The electric conductor films 18*b* and 19*b* are made of a copper film and are formed of copper that is vapor-deposited on the tape 17. The film faces of the electric conductor films 18*b* and 19*b* are formed so as to be substantially parallel to the side circumferential face 5*c* of the center pole 5*a* and the opposite face 5*g* of the stepped portion 5*e* (described later) when the voice coil bobbin 4 is fitted to the center pole 5. The first electrode 18 is formed by means of that the electric conductor films 18*a* and 18*b* are laminated through the tape 17, and the second electrode 19 is formed by means of that the electric conductor films 19*a* and 19*b* are laminated through the tape 17.

After the first electrode 18 and the second electrode 19 are formed on the insulator film 20, the bobbin 13 is formed by means of that, both end portions in the longitudinal direction of the insulator film 20 are stuck on each other with an adhesive such that the electric conductor film 16 is located on the outer side and the first electrode 18 and the second electrode 19 are located on the inner side to form the insulator film 20 in a cylindrical shape. After that, the coil 14 is wound around the outer circumferential face of the bobbin 13, that is, wound on the electric conductor film 16 to form the voice coil bobbin 4. The opening on the rear end side of the voice coil bobbin 4 structured as described above is fitted to the center pole 5*a* such that an air gap is formed between the inner peripheral face 8*a* of the circular ring shaped member 8 and the coil 14 and that an air gap is formed between the stepped portion 5*e* which is formed on the side circumferential face 5*c* of the center pole main body 5*a* and the electric conductor films 18*b* and 19*b*.

As shown in FIG. 2, the stepped portion 5*e* is integrally formed in the side circumferential face 5*c* of the center pole main body 5*a* so as to protrude to an outer side in a radial direction of the center pole main body 5*a* from the side circumferential face 5*c* in a circular ring shape. The stepped portion 5*e* is so formed, when the voice coil bobbin 4 is operated or vibrates in the arrow "A" direction in FIG. 1, that a first facing area between one electrode of the first and the second electrodes 18 and 19 and the side circumferential face 5*c* is increased and a second facing area between the other electrode and the side circumferential face 5*c* is decreased by the same amount of the increased amount of the first facing area. The stepped portion 5*e* includes rising faces 5*f*, which substantially perpendicularly rise up from the side circumferential face 5*c* in the radial direction of the center pole main body 5*a*, and an opposite face 5*g* which is substantially parallel to the surfaces of the electric conductor films 18*b* and 19*b*.

The stepped portion 5*e* is formed such that its length "γ" (see FIG. 2) in the axial direction satisfies <Expression 1> below. Further, when the voice coil bobbin 4 is fitted to the center pole main body 5*a* and positioned at a predetermined location, in other words, when the voice coil bobbin 4 is set at a reference position, one of the edges of the stepped portion 5*e* coincides with a bisector 21 (see FIG. 4(*c*)) which divides the electric conductor films 18*a* and 18*b* in half in the direction of the axis 5*d* (in a short length direction of the insulator film 20). In addition, when the voice coil bobbin 4 is set at the reference position, the other of the edges of the stepped portion 5*e* coincides with a bisector 22 (see FIG. 4(*c*)) which divides the electric conductor films 19*a* and 19*b* in half in the direction of the axis 5*d* (in the short length direction of the insulator film 20). In addition, when the voice coil bobbin 4 is operated, in other words, when the voice coil bobbin 4 vibrates and shifts from the reference position, the stepped portion 5*e* is formed such that the opposite face 5*g* does not move away in the direction of the axis 5*d* from a facing region of the first and the second electrodes 18 and 19 and that the opposite face 5*g* always faces the first electrode 18 and the second electrode 19. In this embodiment, the stepped portion 5*e* is formed such that, when the voice coil bobbin 4 is set at the reference position, one of the edges of the stepped portion 5*e* coincides with the bisector 21 and the other of the edges of the stepped portion 5*e* coincides with the bisector 22. However, the present invention is not limited to this embodiment and the stepped portion 5*e* may be formed such that, when the voice coil bobbin 4 is set at the reference position, the first facing area between the opposite face 5*g* and the electric conductor films 18*a* and 18*b* is the same as the second facing area between the opposite face 5*g* and the electric conductor films 19*a* and 19*b*. According to the structure as described above, when the voice coil bobbin 4 vibrates in the arrow "A" direction in FIG. 1, the first facing area between one of the first and the second electrodes 18 and 19 and the side circumferential face 5*c* is increased while the second facing area between the other of the first and the second electrodes 18 and 19 and the side circumferential face 5*c* is decreased by the same amount of the increased amount of the first facing area.

<Expression 1>

$$\gamma<\beta+2\delta$$

(δ; a length in a short length direction of the electric conductor film which structures the respective electrodes)

The base end of a lead wire 23 is fixed to the electric conductor film 18*b* with solder. A terminal 24 is provided at a tip end of the lead wire 23 and the terminal 24 is connected to a subtracter 31 (see FIG. 5). A base end of a lead wire 25 is fixed to the electric conductor film 19*b* with solder. A terminal 26 is provided at a tip end of a lead wire 25 and the terminal 26 is connected to the subtracter 31. A base end of a lead wire 27 is fixed to the center pole 5 with solder. A terminal 28 is provided at a tip end of the lead wire 27 and the terminal 28 is connected to the subtracter 31. In this manner, a first electrical signal indicating an electrostatic capacity formed between the opposite face 5g and the first electrode 18 is inputted into the subtracter 31 from the first electrode 18, and a second electrical signal indicating an electrostatic capacity formed between the opposite face 5g and the second electrode 19 is inputted into the subtracter 31 from the second electrode 19.

Figure 5:
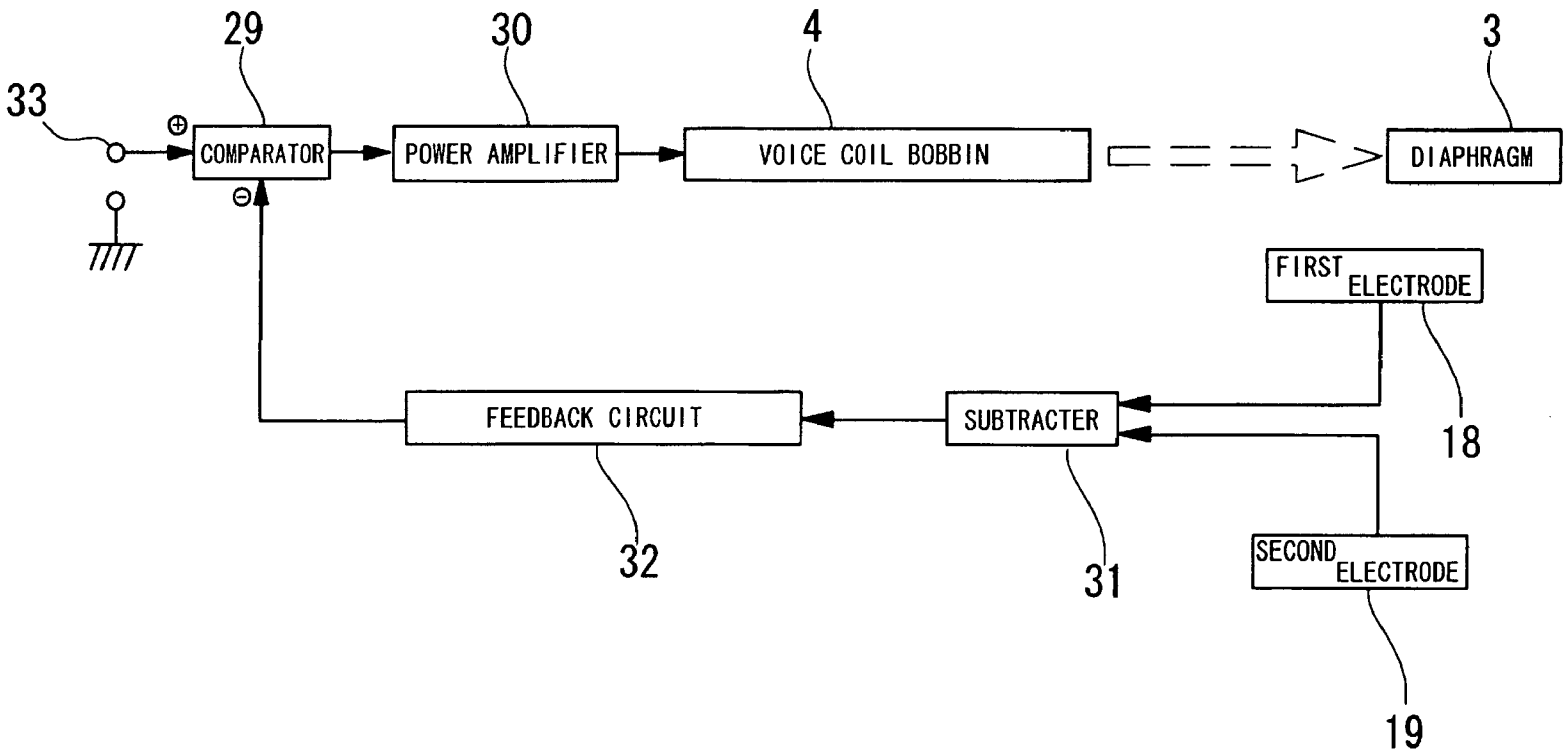
FIG. 5 is a functional block diagram showing an electrical structure of a speaker.

As shown in FIG. 5, the speaker 1 is provided with a comparator 29, a power amplifier 30, the subtracter 31 and a feedback circuit 32. An electrical signal (hereinafter, referred to as "audio signal") indicating audio information that is inputted to an input terminal 33 is inputted into the power amplifier 30 through the comparator 29 that is comprised of an integrated circuit. An audio signal that is amplified by the power amplifier 30 is inputted into the voice coil bobbin 4. When an audio signal flows in the coil 14 of the voice coil bobbin 4, the voice coil bobbin 4 is vibrated in a forward and backward direction (the arrow "A" direction shown in FIG. 1) by exciting operation. The diaphragm 3 vibrates with the vibration of the voice coil bobbin 4 to emit a sound or the like from the speaker 1.

The first electrode 18 inputs the first electrical signal indicating an electrostatic capacity formed between the opposite face 5g and the first electrode 18 into the subtracter 31. The second electrode 19 inputs the second electrical signal indicating an electrostatic capacity formed between the opposite face 5g and the second electrode 19 into the subtracter 31. The subtracter 31 is, for example, comprised of a differential amplifier and the second electrical signal inputted from the second electrode 19 is subtracted from the first electrical signal inputted from the first electrode 18. The third electrical signal corresponding to the subtracted result is inputted into the feedback circuit 32. In the feedback circuit 32, the comparator 29 and the power amplifier 30, the following feedback control is performed on the basis of the third electrical signal that is inputted from the subtracter 31. The feedback circuit 32 performs a prescribed signal processing to the third electrical signal inputted from the subtracter 31 to input a feedback signal corresponding to the processing result into the comparator 29. The comparator 29 compares a predetermined reference value with the feedback signal in response to the feedback signal inputted from the feedback circuit 32 to calculate the difference between the predetermined reference value and the feedback signal. A correction signal for correcting an audio signal is inputted into the power amplifier 30 on the basis of the calculated result. The power amplifier 30 corrects an output level of the audio signal on the basis of the correction signal inputted from the comparator 29 to input the corrected audio signal into the voice coil bobbin 4. In this embodiment, the feedback circuit 32 comprises an integration circuit, a buffer amplifier, an electronic volume, an adding circuit and the like (not shown).

Next, the operation based on the above-mentioned structure will be described below. When an audio signal is inputted into the input terminal 33, the voice coil bobbin 4 vibrates on the basis of the audio signal. When the vibration occurs, the first facing area between one of the first electrode 18 and the second electrode 19 and the opposite face 5g increases and the second facing area between the other electrode and the opposite face 5g decreases by the same amount of the increased amount of the first facing area. In other words, an electrostatic capacity formed between one of the electrodes and the opposite face 5g increases, and an electrostatic capacity formed between the other electrode and the opposite face 5g decreases by the same amount of the increased amount. These electrostatic capacities are detected along with a disturbance noise from the respective electrodes as the first and the second electrical signals.

When the first electrical signal is outputted from the first electrode 18 and the second electrical signal is outputted from the second electrode 19, the first electrical signal obtained from the first electrode 18 includes an electrical signal indicating a real electrostatic capacity formed between the first electrode 18 and the opposite face 5g and an electrical signal indicating a disturbance noise entering into the first electrode 18. On the other hand, the second electrical signal obtained from the second electrode 19 includes an electrical signal indicating a real electrostatic capacity formed between the second electrode 19 and the opposite face 5g and an electrical signal indicating a disturbance noise entering into the second electrode 19.

Figure 6:
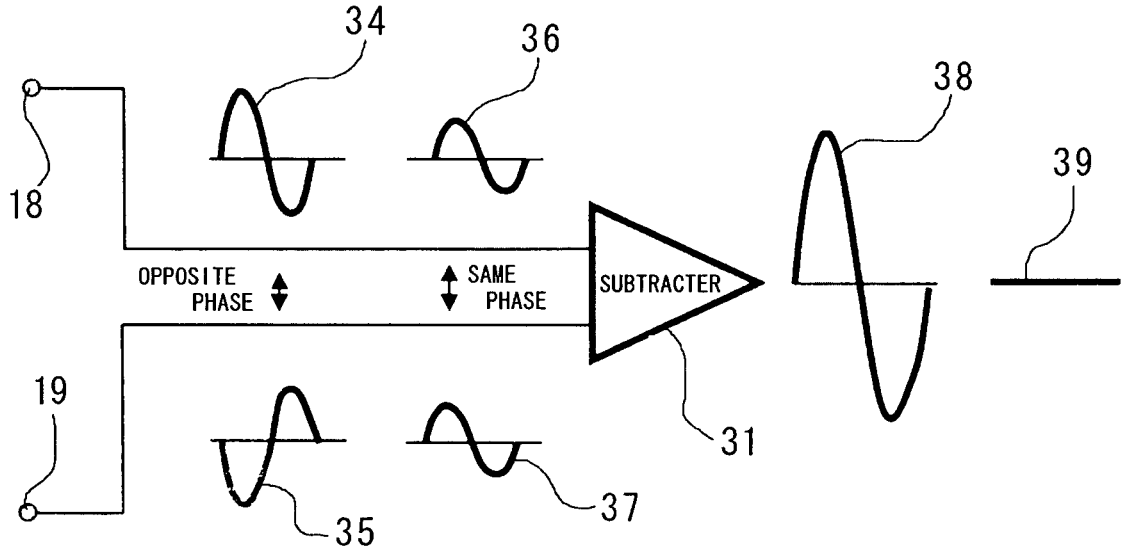
FIG. 6 is a view showing voltage waveforms of signal components of a first, a second and a third electrical signals.

As described above, when a first electrostatic capacity formed between one of the electrodes and the opposite face 5g increases, a second electrostatic capacity formed between the other electrode and the opposite face 5g decreases by the same amount of the increased amount of the first electrostatic capacity. Therefore, as shown in FIG. 6, the voltage waveform 34 of an electrical signal indicating the real electrostatic capacity formed between the first electrode 18 and the opposite face 5g becomes to be in an opposite phase to the voltage waveform 35 of an electrical signal indicating the real electrostatic capacity formed between the second electrode 19 and the opposite face 5g. Further, since a disturbance noise occurs, for example, based on a current flowing through the coil 14, as shown in FIG. 6, the voltage waveform 36 of an electrical signal indicating the disturbance noise entering into the first electrode 18 becomes to be in the same phase as the voltage waveform 37 of an electrical signal indicating the disturbance noise entering into the second electrode 19.

The subtracter 31 subtracts the second electrical signal from the first electrical signal in response to that the first and the second electrical signals are inputted into the subtracter 31 from the first electrode 18 and the second electrode 19. When a signal component indicating the true electrostatic capacity, which is formed between the second electrode 19 and the opposite face 5g, is subtracted from a signal component indicating the true electrostatic capacity which is formed between the first electrode 18 and the opposite face 5g, these signal components are in an opposite phase relation. As a result, as shown by the voltage waveform 38 in FIG. 6, an electrical signal is obtained in which the signal component indicating the true electrostatic capacity formed between the first electrode 18 and the opposite face 5g is added with the same signal component indicating the true electrostatic capacity formed between the second electrode 19 and the opposite face 5g On the other hand, when a signal component indicating the disturbance noise which enters into the second electrode 19 subtracts from a signal component indicating the disturbance noise which enters into the first electrode 18, these signal components are cancelled each other as shown by the voltage waveform 39 in FIG. 6 because they are in the same phase. The subtracter 31 outputs a third electrical signal in which an electrical signal corresponding to the voltage waveform 38 is added to an electrical signal corresponding to the voltage waveform 39.

As described above, since the third electrical signal obtained from the subtracter 31 does not include a signal component indicating the disturbance noise, an accurate feedback control can be carried out. Further, the electric conductor films 18a and 18b are laminated through the tape 17 and the electric conductor films 19a and 19b are laminated through the tape 17. Therefore, the electrostatic capacity formed between the first electrode 18 and the center pole main body 5a and the electrostatic capacity formed between the second electrode 19 and the center pole main body 5a can be increased. In addition, the electric conductor films 16, 18*a* and 19*a* function as a shield for shutting off a disturbance noise and thus the entering of the disturbance noise into the first and the second electrodes 18 and 19 can be suppressed.

Figure 7:
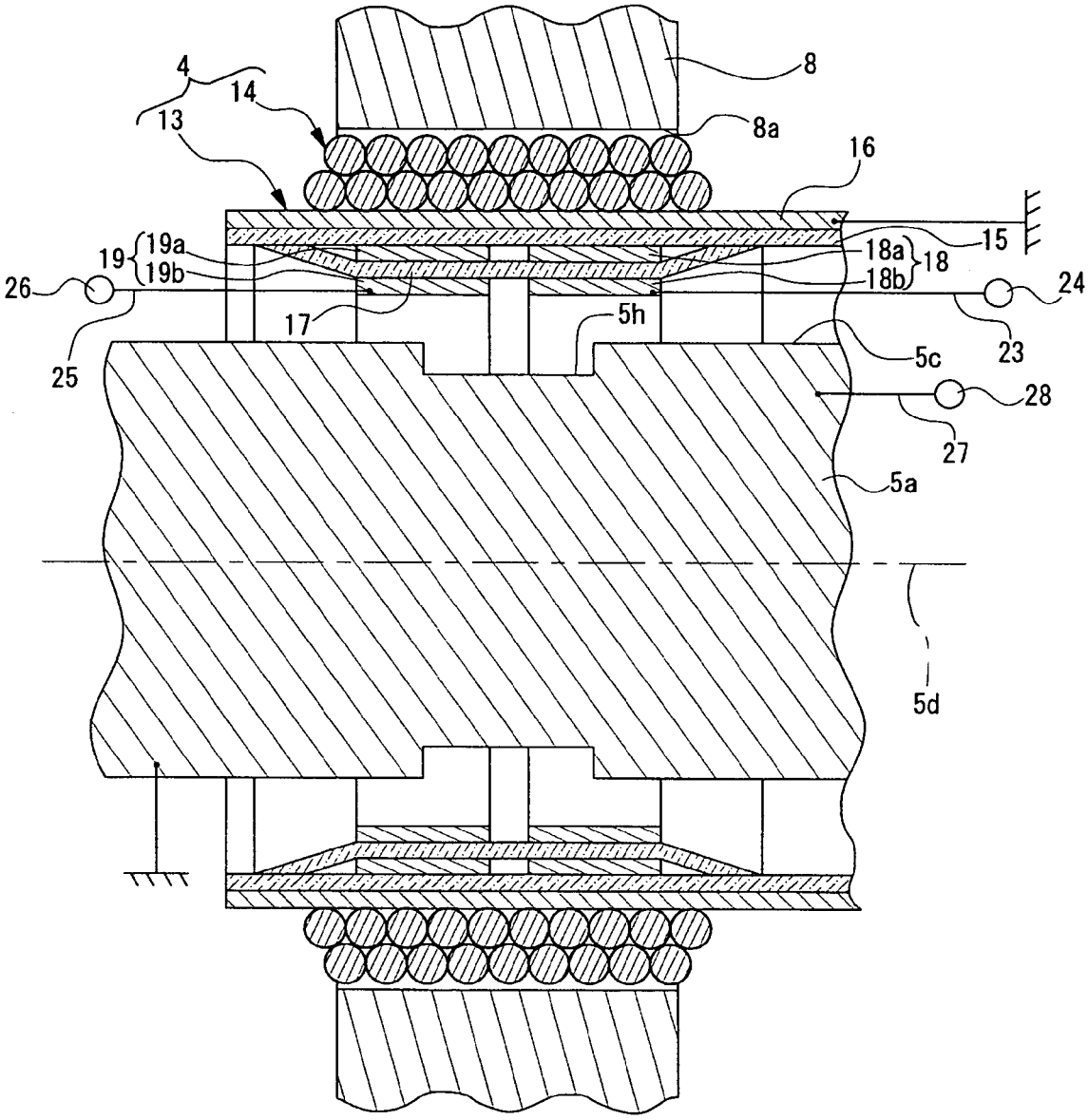
FIG. 7 is a cross-sectional view showing parts of a voice coil bobbin, a center pole and a circular ring shaped member in accordance with another embodiment of the present invention.
Figure 8:
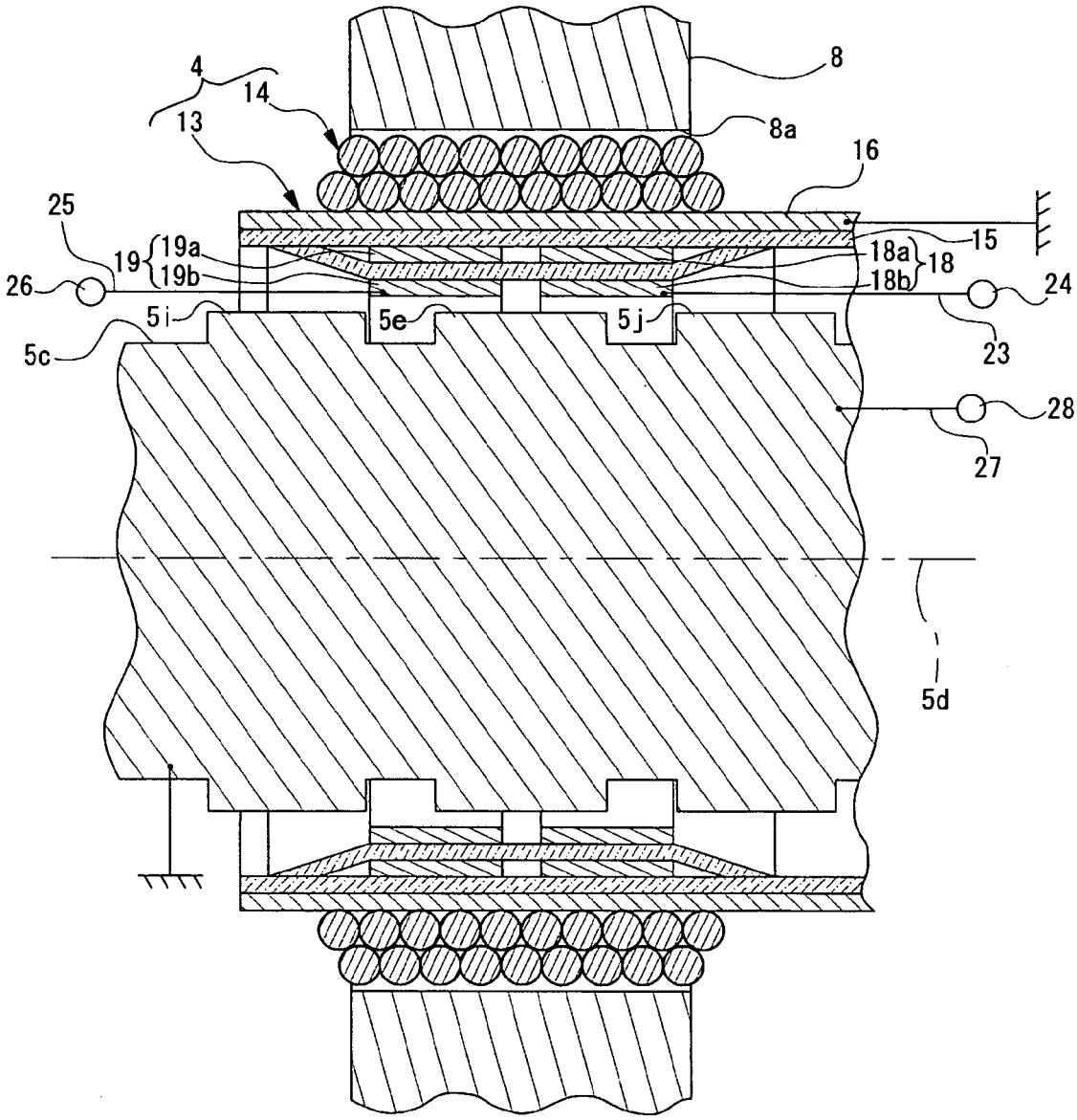
FIG. 8 is a cross-sectional view showing parts of a voice coil bobbin, a center pole and a circular ring shaped member in accordance with another embodiment of the present invention.

The present invention has been described in detail using the embodiments, but the present invention is not limited to the embodiments described above and many modifications can be made without departing from the present invention. For example, in the embodiment described above, the stepped portion 5*e* whose cross section is in a protruded shape is formed in the side circumferential face 5*c*. However, the present invention is not limited to this embodiment and, as shown in FIG. 7, a concave stepped portion 5*h* is formed in the side circumferential face 5*c* to vary a facing area between the respective electrodes and the side circumferential face 5*c*. Further, as shown in FIG. 8, stepped portions 5*i* and 5*j* having the same size and shape as the stepped portion 5*e* may be formed in the side circumferential face 5*c* so as to be adjacent to the stepped portion 5*e*. As described above, even when the length "δ" in the short length direction of the respective electrodes and the length in the axis 5*d* direction of the center pole main body 5*a* are shortened by forming a plurality of stepped portions along the axis 5*d*, the variation amount of a facing area between the side circumferential face 5*c* and the respective electrodes can be sufficiently assured.

In the embodiment described above, the first electrode 18 is structured by using the laminated electric conductor films 18*a* and 18*b*, and the second electrode 19 is structured by using the laminated electric conductor films 19*a* and 19*b*. However, the respective electrodes may be structured by using three or more laminated electric conductor films. In this case, an insulator film is interposed between an electric conductor film and another electric conductor film. A plastic film having an insulation property such as polyimide or polyester is preferably used as an insulator film. According to the structure as described above, the relative permittivity increases and the electrostatic capacity detected in the respective electrodes can be further increased.

In the embodiment described above, the electric conductor films 16, 18*a*, 18*b*, 19*a* and 19*b* are formed of copper but the present invention is not limited to this embodiment. For example, the electric conductor films 16, 18*a*, 18*b*, 19*a* and 19*b* may be formed of aluminum or electro-conductive plastic and, when a nonmagnetic electric conductor film is used, its material can be appropriately modified.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A speaker comprising:

a center pole;

a voice coil bobbin which comprises a nonmetallic pipe body; and a first and a second electrodes which are provided on an inner peripheral face of the nonmetallic pipe body for detecting an electrostatic capacity that is formed between the electrodes and the center pole, and the first and the second electrodes being disposed on the inner peripheral face and separated from each other with a predetermined space along an axial direction of the center pole;

a stepped portion which is formed in a side circumferential face of the center pole; and a subtracter which subtracts a second electrical signal obtained from the second electrode from a first electrical signal obtained from the first electrode and outputs a third electrical signal corresponding to a result of the subtraction;

wherein, when the voice coil bobbin is operated, a first facing area of the first electrode to the side circumferential face defined by the stepped portion of the center pole increases while a second facing area of the second electrode to the side circumferential face defined by the stepped portion of the center pole decreases by a same amount as an increased amount of the first facing area.

2. The speaker according to claim 1, wherein each of the first and the second electrodes is made of nonmagnetic electric conductor films which are laminated through an insulator film.

3. The speaker according to claim 1, further comprising a nonmagnetic electric conductor film which is formed on an outer circumferential face of the pipe body and which is grounded.

4. A speaker comprising:

a center pole;

a voice coil bobbin which comprises a nonmetallic pipe body; and a first and a second electrodes which are provided on an inner peripheral face of the pipe body for detecting an electrostatic capacity that is formed between the electrodes and the center pole, and the first and the second electrodes being disposed on the inner peripheral face and separated from each other with a predetermined space along an axial direction of the center pole; and a stepped portion which is formed in a side circumferential face of the center pole;

wherein, when the voice coil bobbin is operated, a first facing area of the first electrode to the side circumferential face defined by the stepped portion of the center pole increases while a second facing area of the second electrode to the side circumferential face defined by the stepped portion of the center pole decreases by a same amount as an increased amount of the first facing area.

5. The speaker according to claim 4, wherein a second electrical signal obtained from the second electrode is subtracted from a first electrical signal obtained from the first electrode to obtain a third electrical signal corresponding to a result of the subtraction.

6. The speaker according to claim 4, wherein the center pole comprises a cylindrical center pole main body, and the stepped portion is protruded to an outer side from the side circumferential face of the cylindrical center pole main body to form a circular ring shape protruded portion, and the stepped portion comprises rising faces which are formed to be risen up at a substantially right angle from the side circumferential face in a radial direction of the center pole main body and an opposite face which faces in a substantially parallel to the first and the second electrodes.

7. The speaker according to claim 6, wherein a first facing area of the opposite face of the center pole main body to the first electrode is set to be the same as a second facing area of the opposite face of the center pole main body to the second electrode when the voice coil bobbin is located at a reference position.

8. The speaker according to claim 7, wherein a first edge that is formed by one of the rising faces and the opposite face of the stepped portion is located at a position where the first edge divides the first electrode in half in the axial direction of the center pole when the voice coil bobbin is located at the reference position, and a second edge that is formed by the other of the rising faces and the opposite face of the stepped portion is located at a position where the second edge divides the second electrode in half in the axial direction of the center pole when the voice coil bobbin is located at the reference position.

9. The speaker according to claim 4, wherein the center pole comprises a cylindrical center pole main body, and the stepped portion is recessed to an inner side from the side circumferential face of the cylindrical center pole main body to form a circular ring shape recessed portion.

10. The speaker according to claim 9, wherein a first facing area of the side circumferential face of the center pole main body to the first electrode is set to be the same as a second facing area of the side circumferential face of the center pole main body to the second electrode when the voice coil bobbin is located at a reference position.

* * * * *